United States Patent [19]

Gorsen

[11] Patent Number: 4,865,022

[45] Date of Patent: Sep. 12, 1989

[54] SELF APPLICABLE SPRING LOADED PELVIC TRACTION DEVICE

[76] Inventor: Robert M. Gorsen, 1549 Bruton Ct., McLean, Va. 22102

[21] Appl. No.: 340,358

[22] Filed: Apr. 19, 1989

[51] Int. Cl.[4] ..... A61H 1/02

[52] U.S. Cl. ..... 128/75; 128/71; 128/78

[58] Field of Search ..... 128/75, 78, 71, 84 R, 128/84 C, 72

[56] References Cited

U.S. PATENT DOCUMENTS

| | | | |
|---|---|---|---|
| 807,908 | 12/1905 | Bradstreet . | |
| 1,239,522 | 9/1917 | La Rock | 128/71 |
| 1,562,294 | 11/1925 | Cooper . | |
| 1,915,841 | 6/1933 | Warner | 128/75 |
| 2,573,866 | 11/1951 | Murphy . | |
| 2,660,999 | 12/1953 | Thornton | 128/71 |
| 2,772,674 | 12/1956 | Swiech et al. . | |
| 2,774,349 | 12/1956 | Judovich | 128/71 |
| 2,966,906 | 1/1961 | Wiltrout . | |
| 3,086,519 | 4/1963 | Pari | 128/75 |
| 3,167,068 | 1/1965 | Carr | 128/84 R |
| 3,176,684 | 4/1965 | Walsh | 128/84 R |
| 3,295,517 | 1/1967 | Stevens . | |
| 3,390,675 | 7/1968 | Giannestras | 128/84 R |
| 3,662,750 | 5/1972 | Jorgensen | 128/75 |
| 3,797,483 | 3/1974 | Feldman | 128/75 |
| 4,065,814 | 1/1978 | Fox . | |
| 4,114,611 | 9/1978 | Lyle et al. | 128/75 |
| 4,133,307 | 1/1979 | Ness | 128/75 |
| 4,236,265 | 12/1980 | Carradine | 128/84 R |
| 4,407,274 | 10/1983 | Goodley | 128/87 B |
| 4,580,554 | 4/1986 | Goodley | 128/75 |
| 4,586,494 | 5/1986 | Singleton | 128/75 |
| 4,602,627 | 7/1986 | Vito et al. . | |
| 4,624,245 | 11/1986 | Mullin et al. | 128/75 |

*Primary Examiner*—William Pieprz
*Assistant Examiner*—Huong Q. Pham
*Attorney, Agent, or Firm*—A. Robert Theibault

[57] ABSTRACT

A self applicable spring loaded pelvic traction device to be self applied by a patient, comprising an adjustable waist encircling belt member, a pair of right and left leg adjustable scored leg straps, each strap having one end secured to the side of the belt member and another and secured to the rear of the belt member, a foot bar, helical spring connected between the foot bar and the right and left adjustable straps for applying a counter thrust to the thrust of the legs of a patient requiring traction to extend the spring to apply the traction, a pair of inner and outer telescopic cylindrical tubes received over the helical spring, one of the tubes being secured to the top of the helical spring and the other of the telescopic tubes being secured to the foot bar, the inner cylindrical tube having calibration lines and numerals readable against the lower end of the outer telescopic cylindrical tube to indicate the pounds of traction pull exerted between the waist and feet of the patient, a traction post attachable to a bed frame variably positionable along the length or width of the bed to regulate the amount of traction to which the patient is subjected, foot pads pivoted on the foot bar, and an anchor connected to the foot bar between the foot pads and being received over the traction post to regulate the amount of traction to which the patient is subjected.

6 Claims, 3 Drawing Sheets

SELF APPLICABLE SPRING LOADED PELVIC TRACTION DEVICE

TECHNICAL FIELD

The present invention is directed to pelvic traction devices of the type permitting the patient to apply the device to himself or herself not requiring the presence of a second person or orthopedic specialist present to apply traction and/or to attain the proper state of traction force without requiring the specialist present when the patient wishes to have traction applied.

BACKGROUND ART

Heretofore many forms of apparatus have been devised to apply pelvic traction to a patient which required systems of superstructures mounted on patients beds employing weights, cables or ropes to pull on a patients pelvis to exert a linear pull on the lower spine. In most cases the application of traction required more than one person be present to assist in application and removal of traction to a patient lying in a bed. The presently described traction system permits the patient to place him or herself in traction without assistance of others once the traction pull requirements are established. The closest art known to me for permitting a patient to self-apply traction is the form of traction belt shown in U.S. Pat. No. 2,966,906 to C. A. Wiltrout employing a system of adjustable straps crisscrossing a waist belt with guides connected to a waist encircling belt. The following structures were found on a search of the prior art caused to be made by me:

| | | |
|---|---|---|
| U.S. Pat. Nos.: | 807,908 | 2,966,906 |
| | 1,562,294 | 3,295,517 |
| | 2,573,866 | 4,065,814 |
| | 2,772,674 | 4,602,627 |

DISCLOSURE OF THE INVENTION

In accordance with my invention I provide a pelvic traction device similar to but superior in efficacy to present traction devices requiring weights to exert traction and the general need for a second person to place a patient in traction.

My traction system requires an elastic VELCRO (hook and loop material) attaching corset or belt similar to that available on the market today but modified to better fit my traction device, attached to the elastic corset or belt are adjustable scored straps connected to one or more extension springs. The free end of the extension springs attach to a foot plate or bar capable of accommodating both feet together or a single foot at a time. At the base of the foot plate there is provided a loop of metal or plastic sturdy enough when placed over a stationary rod or post to provide constant traction making it unnecessary for the legs to always be in an extended position on the foot plate otherwise necessary to extend the spring and exert traction. Available springs can easily be quantitated to specific poundage dependant on length of extension and may be equated to weight-based traction systems by strap adjustments for an individual patient.

My traction device does not require a second person to assist with application or disapplication of the device upon a patient and placing the patient in traction. The patient places himself in the elastic waist belt, lies down on the traction support surface and places his feet in the foot plate or bar and extends his legs to exert traction. Due to the possibilities of leg pain in certain patients when their legs are extended for long periods, a traction post is attached to the bed or traction frame and is available for the loop at the base of the foot plate to be placed over a traction post to maintain traction allowing both legs to be free. This procedure can be done without help by placing only one leg in the foot plate while the other leg remains on the bed or surface to be used as a patient support. The leg in the foot plate is lifted and then lowered so as to allow the foot plate base loop to be placed over and about the traction post. Other advantages are that the system is lightweight and easy to transport as it does not require a large number of cables and heavy weights as required for other systems.

BEST MODE FOR CARRYING OUT THE INVENTION

Figure 1:
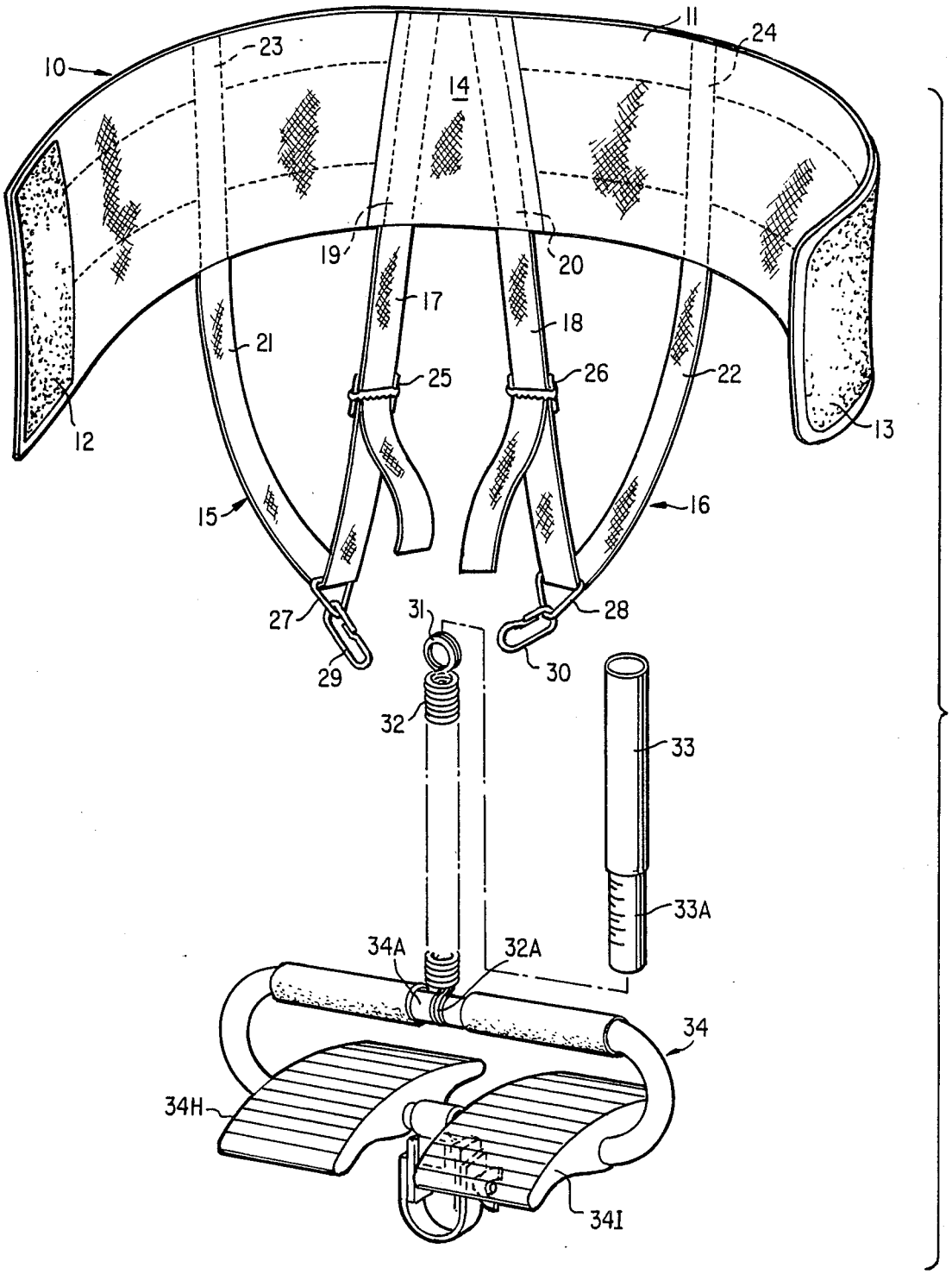
FIG. 1 is a perspective view of one form of my self applicable spring loaded pelvic traction device for application to the user without medical or orthopedic assistance.
Figure 4:
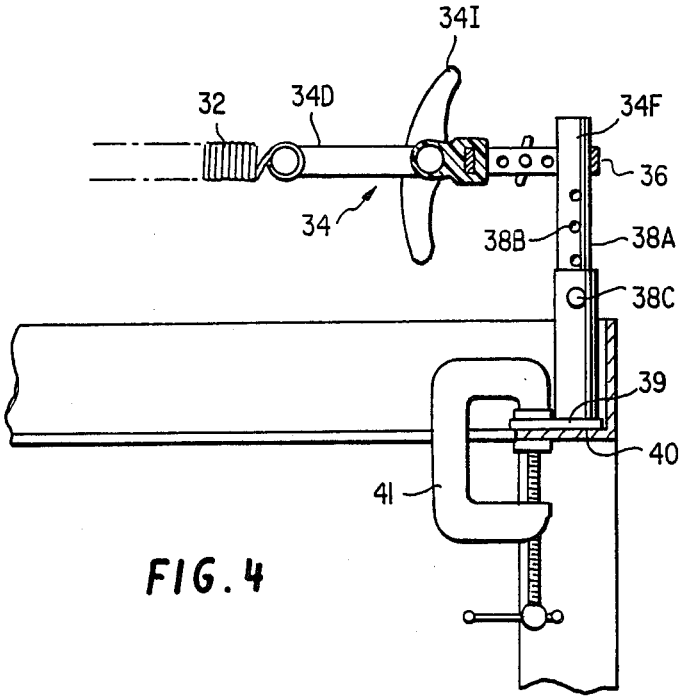
FIG. 4 is a fragmentary longitudinal sectional view of the form of device shown in FIG. 2 with parts broken away and parts shown in section, as applied to a traction post secured to the foot of a bed frame.

Referring now to the drawings and more particularly to FIG. 1, 10 designates the self applicable spring loaded pelvic traction device of my invention ready to be self applied by a patient. An adjustable pelvis encircling belt member 11 having complemental VELCRO (hook and loop material) fasteners 12, 13 at each end of the belt are engaged after passing the belt about the waist of the patient. An elastic rear panel 14 permits of limited expansion of the belt 11. A right and left pair of adjustable scored straps 15, 16 consist of straps 17, 18 stitched to the rear elastic panel 14 at 19, 20 while straps 21, 22 are stitched to the front portion of the belt 11 at 23, 24. Attaching buckles or VELCRO (hook and loop material) strips 25 join the right side straps 15 while the left side straps 16 are joined by attaching buckles or VELCRO (hook and loop material) strips 26 having spring attachment slides 27, 28 which carry spring attaching clips 29, 30 which are attached to the eye 31 of main traction spring 32. Receivable over traction spring 32 are a pair of telescopic tubes 33, 33A one of which is calibrated in pounds to measure traction pull. The inner tube of the pair of telescopic tubes is secured to the foot bar 34 and is calibrated in pounds pull for the traction spring 32 and is anchored to the foot bar 34. The foot bar 34 is connected to the lower end of traction spring 32 as best seen in FIGS. 1 and 4. The foot bar 34 has a top portion 34A and bottom portion 34B joined by closed loops 34C and 34D. Spring connector 34E as shown in FIG. 4, has an eye end 32A which passes over the bar portion 34F best seen in FIG. 2, where dual traction springs 32A, 32B to each side of the brace 34D are shown secured by the spring attaching clips 29, 30.

Figure 2:
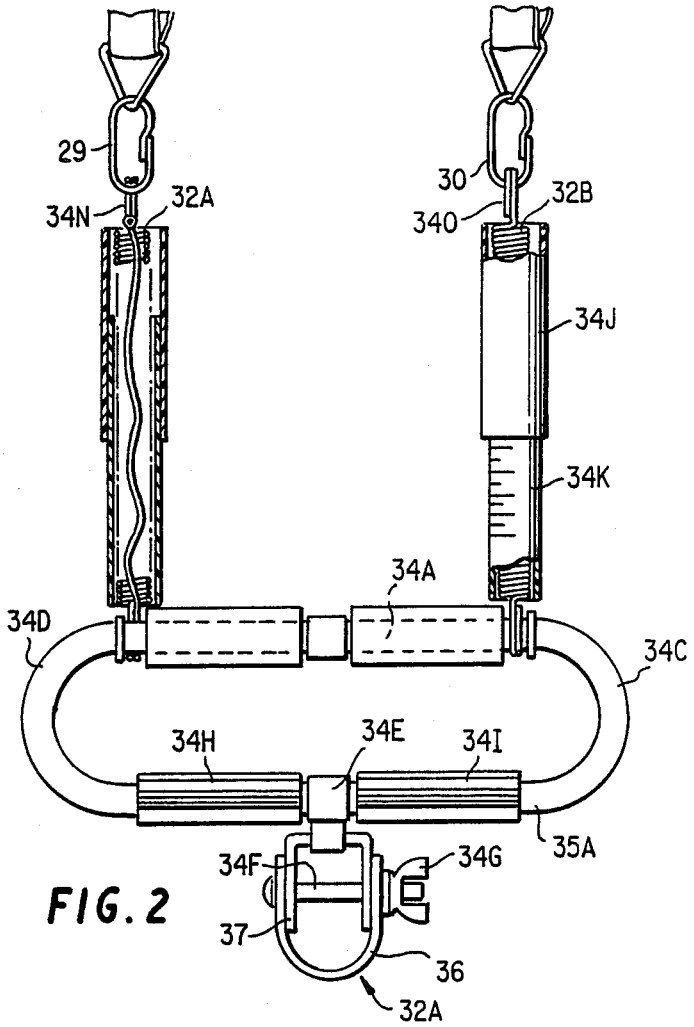
FIG. 2 is a top elevational view of a modified form of my self applicable spring loaded pelvic traction device employing two sets of helical spring means connectable between the foot bar and adjustable leg straps having parts broken away and parts shown in section.
Figure 3:
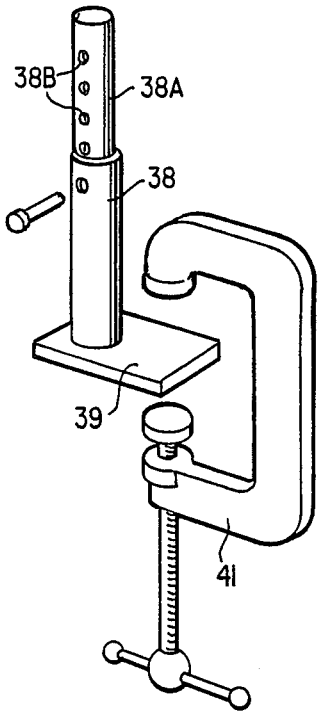
FIG. 3 is a perspective view of the traction post and its base for attachment to a bed frame by an adjustable C-clamp for positioning the post transversely along the foot of a bed frame or other rigid patient support surface.

As best seen in FIGS. 2 and 3 the foot bar attaching loop 36 is shown as comprising a U-shaped member 37 secured to the brace 34D at 34E by a bolt 34F and wing nut 34G. Foot plate 34H is mounted on the bottom portion 35A of the foot bar 34.

As best seen in FIG. 2 a pair of telescopic sleeves 34J and 34K are receivable over the main traction springs 32A and 32B and are secured to their end loops 34N and 340 by spring attaching clips 29, 30. The telescopic outer tubes are secured to the top of springs 32A and 32B while the inner telescopic tubes have poundage of traction calibrations and are secured to the foot bar 34. A traction post 38 is mounted on a skid base 39 slidable along the patients bed frame 40 and attached thereto by a C-clamp 41. The post 38 has a vertically adjustable inner post 38A having openings 38B to permit passage of locking pins 38C so that the attaching loop 36 will be receivable over the post 38A as best seen in FIG. 4.

Figure 5:
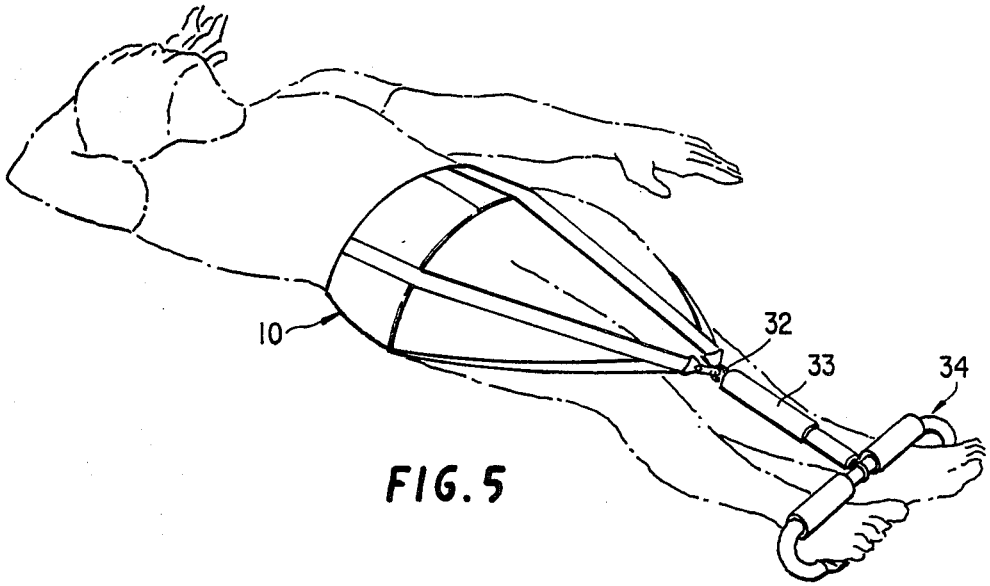
FIG. 5 is a perspective view of the form of my invention shown in FIG. 1 applied to the outline of a patient in traction.

Referring now to FIG. 5 the form of my improved traction device shown in FIG. 1 is shown when applied to a patient, outlined in chain lines, not requiring a traction post but using his feet to distend the spring 32.

Figure 6:
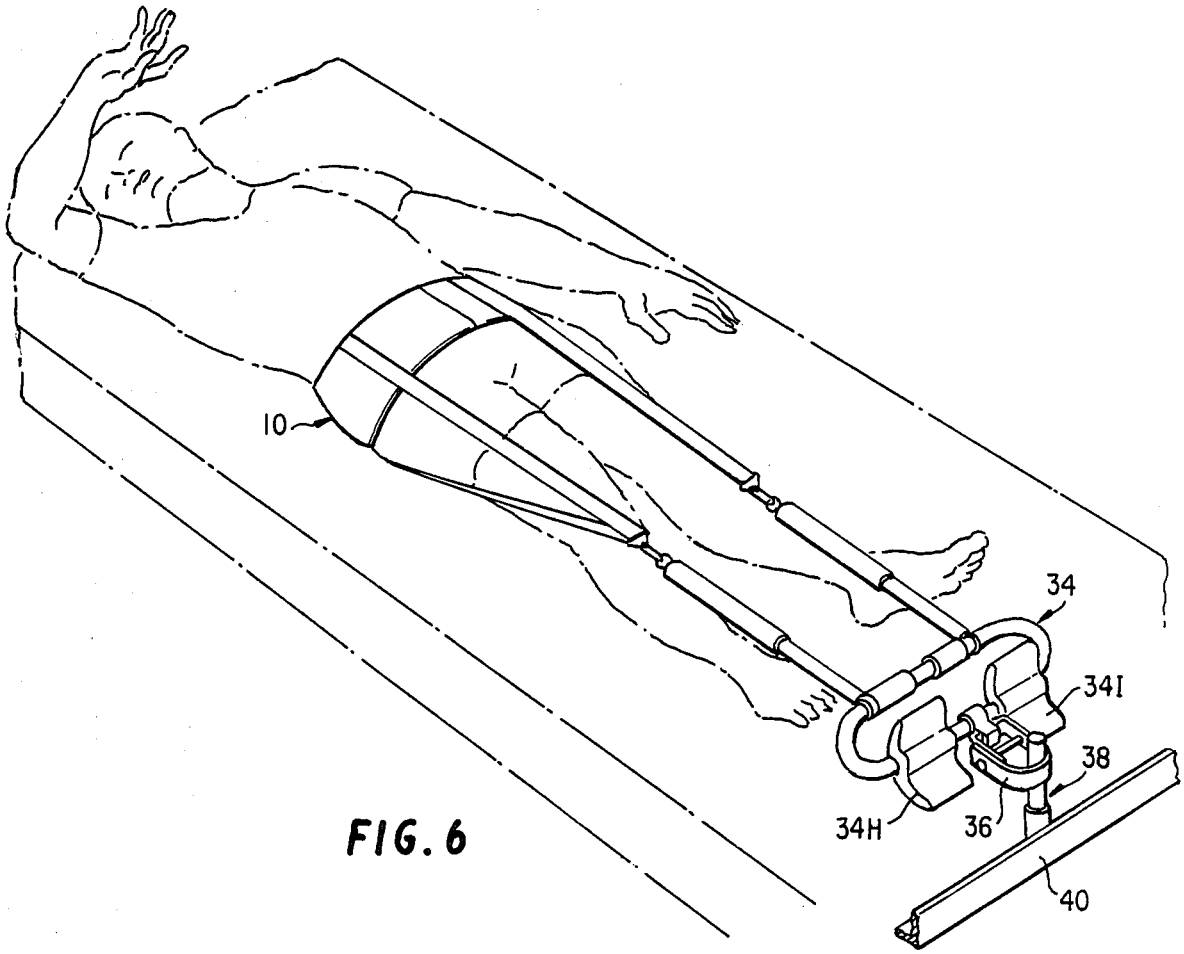
FIG. 6 is a perspective view of the form of my invention show in FIG. 2 with the anchor means beneath the foot bar engaged over the traction post secured to the foot of the patient support surface.

Referring now to FIG. 6 the form of my traction device shown in FIGS. 2, 4 and 6 is used with a traction post 38 secured to the patients bed support frame 40. While I have shown single springs 34L and 34M employed in FIG. 2 it will be understood by those skilled in the art that plural springs may be employed in each set of telescopic calibrated tubes to obtain the desired pounds of traction for each patient. The pounds of traction are prescribed by the attending physician.

Normal traction is about 20 pounds. The normal periods of traction are two hours on and two hours off except during sleeping hours or as varied by physician in attendance. The straps as shown in FIG. 1 are first set at score marks for twenty pounds and are adjustable up or down to reach desired traction, each score line being spaced one half inch from one another. The present traction device requires only one person to make initial setting in addition to physician who prescribes amount of traction. The second person in the initial setup adjusts the scored straps so that when patients legs are fully extended the requisite amount of traction is applied with the patients legs fully extended with the feet in on the foot plates 34H and 34I, shown on the telescopic tubes 33, 33A. After the initial setting the patient can merely attach the waist belt about the pelvis, place his or her feet in the foot plates 34H and 34I, the legs fully extended and the attaching loop 36 placed over the upper end of the traction post 38, traction is attained. Once the proper traction has been determined and the buckles on the adjustable straps set a second person will no longer be required permitting the patient to go into and out of traction solo.

What I claim is:

1. A self applicable spring loaded pelvic traction device to be self applied by a patient, comprising an adjustable waist encircling belt member, a pair of right and left leg adjustable scored leg straps each strap having one end secured to the side of the belt member and another end secured to the rear of said belt member, a foot bar, helical spring connected between said foot bar and said right and left adjustable straps for applying a counter thrust to the thrust of the legs of a patient requiring traction to extend the spring to apply the traction, a pair of inner and outer telescopic cylindrical tubes received over said helical spring, one of said tubes being secured to the top of said helical spring and the other of said telescopic tubes being secured to said foot bar, the inner cylindrical tube having calibration lines and numerals readable against the lower end of said outer telescopic cylindrical tube to indicate the pounds of traction pull exerted between the waist and feet of the patient, a traction post attachable to a bed frame variably positionable along the length or width of the bed to regulate the amount of traction to which the patient is subjected, foot pads pivoted on the foot bar, and an anchor means connected to the foot bar between said foot pads and being received over said traction post to regulate the amount of traction to which the patient is subjected.

2. A self applicable spring loaded pelvic traction device to be self applied by a patient on a traction body support surface as claimed in claim 1, wherein said pelvis encircling belt member has complemental VELCRO fasteners at each end of belt, one being on the outside of the belt and the other being on the inside of the belt.

3. A self applicable spring loaded pelvic traction device to be self applied by a patient on a traction body support surface as claimed in claim 2, wherein said right and left leg adjustable scored leg straps each comprise first and second straps, each said first strap having said one end secured to the side of said encircling belt member and another end which has an attaching means for securing it to said second strap.

4. A self applicable spring loaded pelvic traction device to be self applied by a patient on a traction body support surface as claimed in claim 1, wherein said helical spring comprises two sets of helical spring, a pair of inner and outer telescopic cylindrical telescopic tubes receivable over each one of said two sets of helical springs, one end of each cylindrical springs being connected to one of said right and left leg straps and the other end of each of said helical springs being secured to said foot bar.

5. A self applicable spring loaded pelvic traction device to be self applied by a patient on a traction body support surface as claimed in claim 1, wherein said traction post comprises a skid base movable along a flat portion of said traction support surface and being variably anchorable therealong by an adjustable C-clamp, a pair of vertically adjustable traction post, one of which is secured to said skid base and passable through said anchor means of said foot bar.

6. A self applicable spring loaded pelvic traction device to be self applied by a patient on a traction body support surface as claimed in claim 5, wherein said foot bar is a closed loop tubular bar having a single foot rest mounted for rocking movement to receive the patients foot or feet thereupon.

* * * * *